US005160640A

United States Patent [19]

Badstieber

[11] Patent Number: 5,160,640

[45] Date of Patent: Nov. 3, 1992

[54] FORMWORK PANEL

[75] Inventor: Johann Badstieber, Rutesheim, Fed. Rep. of Germany

[73] Assignee: Josef Maier, Steinach, Fed. Rep. of Germany

[21] Appl. No.: 679,040

[22] PCT Filed: Oct. 14, 1989

[86] PCT No.: PCT/DE89/00654

§ 371 Date: May 13, 1991

§ 102(e) Date: May 13, 1991

[87] PCT Pub. No.: WO90/05224

PCT Pub. Date: May 17, 1990

[30] Foreign Application Priority Data

Nov. 12, 1988 [DE] Fed. Rep. of Germany ..... 3838488

[51] Int. Cl.[5] ..... E04G 9/02

[52] U.S. Cl. ..... 249/189; 249/40; 249/44; 249/47; 249/190; 249/192

[58] Field of Search ..... 249/40, 190, 213, 38, 249/33, 44, 48, 191, 192, 47, 189, 210

[56] References Cited

U.S. PATENT DOCUMENTS

| | | | |
|---|---|---|---|
| 2,336,253 | 12/1943 | Jennings | 249/190 |
| 2,963,763 | 12/1960 | Le Cluyse | 25/131 |
| 3,899,155 | 8/1975 | Ward | 249/189 |
| 4,147,322 | 4/1979 | Dahlstrom | 249/40 |
| 4,744,541 | 4/1988 | Carlson | 249/192 |

FOREIGN PATENT DOCUMENTS

| | | |
|---|---|---|
| 8107576 | 8/1981 | Fed. Rep. of Germany . |
| 3129838 | 2/1983 | Fed. Rep. of Germany . |
| 3630650 | 2/1987 | Fed. Rep. of Germany . |
| 3638537 | 5/1988 | Fed. Rep. of Germany . |
| 778922 | 7/1957 | United Kingdom . |

*Primary Examiner*—Jay H. Woo
*Assistant Examiner*—Khanh P. Nguyen
*Attorney, Agent, or Firm*—Peter K. Kontler

[57] ABSTRACT

A formwork panel has a face plate which is mounted on a frame made up of structural shapes. The panel is reinforced by a set of spaced, parallel reinforcing beams mounted on the back of the face plate. Additional beams are disposed between selected pairs of reinforcing beams. The additional beams are perpendicular to the reinforcing beams and are spaced from the frame. Each additional beam is provided with an opening which registers with a corresponding opening in the face plate. The registering openings receive tie rods which connect two facing formwork panels to one another so as to define a pouring space for concrete.

29 Claims, 2 Drawing Sheets

FORMWORK PANEL

BACKGROUND OF THE INVENTION

The invention relates to a formwork panel having edge profiles running round its edges, stiffening girders which are disposed between the edge profiles and serve to stiffen the forming surface, and anchoring locations for formwork tie rods. The anchoring locations traverse the formwork panel and are disposed in spaced relationship to the edge profiles.

Such a formwork panel is known from German Utility Model No. 81 07 576. The anchoring locations for the formwork tie rods traverse stiffening girders and are provided in spaced relationship to the edge webs. These stiffening girders therefore have a hole which weakens the stiffening girder.

The German Utility Model No. 86 30 650 discloses a formwork panel in which the stiffening girders are composed of shaped timber of solid section enclosed by sheet metal profiles. The edge webs are formed by hollow profiles and the anchoring locations are situated in these edge webs. However, the surfaces of these edge webs then have holes through them. Furthermore, when such formwork panels are used horizontally, considerable difficulties arise for anchoring work close to the ground. In addition, anchoring work in horizontal orientation would not be possible for buildings in which jointing strips or plates are to be attached to connecting points.

SUMMARY OF THE INVENTION

The object underlying the invention is therefore to create a formwork panel of the kind mentioned at the outset which—in any orientation—permits formwork tie rods to be attached without difficulty in spaced relationship to the lowermost formwork panel edge. It is to be possible for the forces coming from the formwork tie rods to be conducted into the formwork panel without impairing or making holes in the stiffeners and without deforming the forming surface.

In order to achieve this object, the formwork panel mentioned at the outset is characterized in that at least one transverse connecting piece is arranged between two spaced stiffening girders and is provided with an anchoring location.

In this manner, a formwork panel is produced in which the anchoring location or locations are still spaced from the outer edge profiles so as not to impair them while, at the same time, no weakening or impairment of the stiffening girders occurs. On the contrary, the stiffening girders are even reinforced by the transverse connecting piece.

It thus becomes possible for the formwork panel to be used horizontally close to the ground without preventing or obstructing attachment of the formwork tie rods. In addition, jointing strips and the like can be provided in the region of the joints. The forces coming from the formwork tie rods are conducted into the formwork panels without difficulty. At the same time, arrangement of the anchoring location directly on a stiffening girder is avoided and the tension from the formwork tie rod is distributed over two, preferably parallel, stiffening girders in an advantageous manner.

The external shapes of the stiffening girders may be identical and at least one of the two stiffening girders joined to the transverse connecting piece may be reinforced and/or have a larger cross section than the other stiffening girders. This makes it all the more possible for the forces from the formwork tie rods to be transferred without difficulty. The overall appearance of the formwork panel as regards the stiffening girders is nevertheless uniform. Therefore, any supports, booms and the like engaging these stiffening girders can be attached to all of them using identical fastening means.

The stiffening girders running between the edge profiles may be parallel to one another and to one of the edges of the formwork panel, and may run horizontally in the position of use - hence vertically when the formwork panel is prone. The transverse connecting pieces with the anchoring locations may be disposed between, and approximately at right angles to, two parallel stiffening girders. These transverse connecting pieces are then of minimum length and conduct the tension to the two parallel stiffening girders along a correspondingly short path.

The stiffening girders may have an approximately U-shaped or trapezoidal cross section, and the opening of such a girder may be closed by the forming surface. This results in good stiffening of the formwork panel in a known manner. The transverse webs of these stiffening girders which face away from the forming surface may be provided with holes for accessory parts. Since all of the stiffening girders, including the reinforced stiffening girders, have essentially identical outer contours, these accessory parts, and particularly the means connecting them to the stiffening girders, need not have different forms.

In a particularly simple embodiment of the invention, a U-shaped or trapezoidal stiffening girder is reinforced in the region of an anchoring location by making such region of thicker sheet metal than the remainder of the stiffening girder.

Another measure for reinforcing a stiffening girder proximate to an anchoring location consists in that stiffening webs, stiffening plates or the like are fitted, particularly welded, into the hollow section of the girder. If this measure, on its own, is sufficient to reinforce the stiffening girder, the latter may advantageously be produced from the same sheet metal or the same rolled section as the remaining, unreinforced stiffening girders of the formwork panel.

An increase in the external dimensions of the formwork panel may be achieved by means of approximately centrally located girders which are parallel to the preferably vertical edge profiles. The stiffening girders abut such central girders on either side and may, in particular, be butt-welded to the same. Advantageously, the anchoring locations are not provided in the profile running round the edge but are moved inwardly, especially when a formwork panel is so large that the single outer frame is replaced by two outer frames which are bridged by the stiffening girders. If the anchoring locations were not moved inwardly, the distance between two anchoring locations might become too great or, in the event that a third anchoring location were provided on the central profile of an enlarged formwork panel between two anchoring locations on the edge profiles, the number of anchoring locations might become excessive. Moving the anchoring locations away from the edges of an enlarged formwork panel also makes it possible to limit the number of anchoring locations which are arranged side-by-side at a given level to two. The forces from the formwork tie rods are then conducted into the reinforced stiffening girders.

Since the edge profiles are not weakened by anchoring locations, they may be engaged by clamps or similar connecting members and additionally have transverse holes for bolts, and slings for cranes, conveyors or the like. These transverse holes, which make it possible, for example, to connect two formwork panels arranged side-by-side in a plane, may be provided at any positions because no anchoring locations are present.

A further measure for reinforcing stiffening girders, which can be advantageously employed even for stiffening girders not in the immediate vicinity of anchoring locations, contributes primarily to good transfer of tension at the stiffening girders proximate to the anchoring locations. This measure may consist in that the transverse web which is provided on a stiffening girder of U-shaped or trapezoidal cross section and is faces away from the forming surface has a corrugation or similar deformation, particularly a deformation of channel-like cross section which is concave as viewed from the outside. This shaping of the stiffening girders proximate to the anchoring locations can also be implemented for the other stiffening girders in order to make the outer contour uniform. However, the shaping is also of benefit to such other stiffening girders when they are used for accessory parts such as brackets, shoring, booms or the like.

The invention provides a very rigid formwork panel in which the anchoring locations are placed so that rectangular formwork panels can be used horizontally without the formwork tie rods being too close to the ground or interfering with jointing plates or the like. The formwork panel of the invention is nevertheless capable of absorbing tension well. The outer shapes of the stiffening girders are the same so that accessory parts can be attached to any stiffening girder, even a reinforced stiffening girder, without difficulty and with identical fasteners.

BRIEF DESCRIPTION OF THE DRAWINGS

The invention described below in greater detail with reference to the accompanying drawings in which.

DESCRIPTION OF THE PREFERRED EMBODIMENTS

Figure 1:
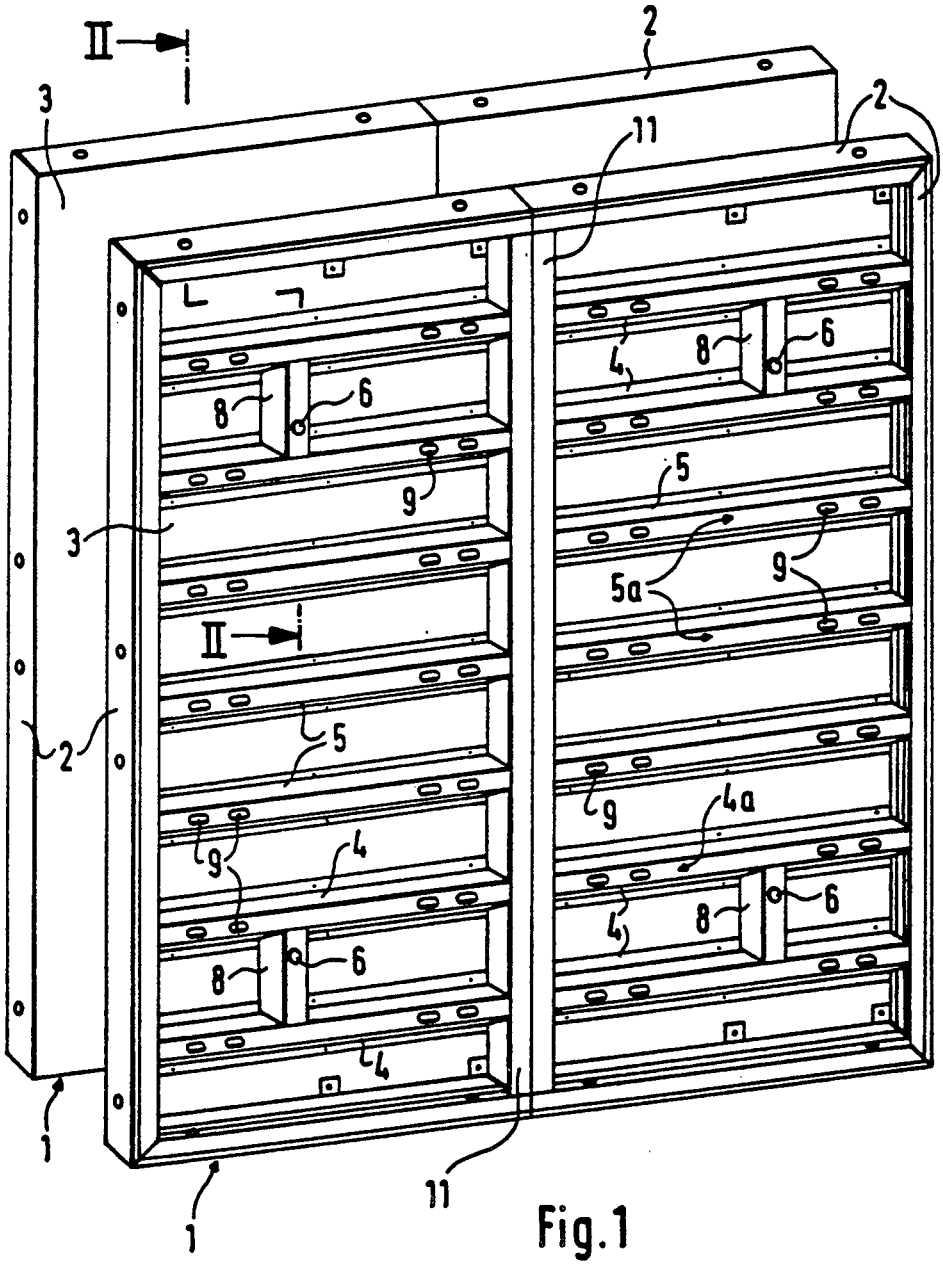
FIG. 1 shows two formwork panels which are disposed opposite each other and are provided with no more than two anchoring locations at any given level.

A formwork panel 1 has edge profiles 2 which run round its edges and are hollow in cross section, and stiffening girders 4 and 5 which are arranged between the edge profiles and serve to stiffen the forming surface 3. Furthermore, the formwork panel 1 is provided with anchoring locations 6 for formwork tie rods, the anchoring locations taking the form of holes and sleeves 7 which traverse the formwork panel 1.

Figure 2:
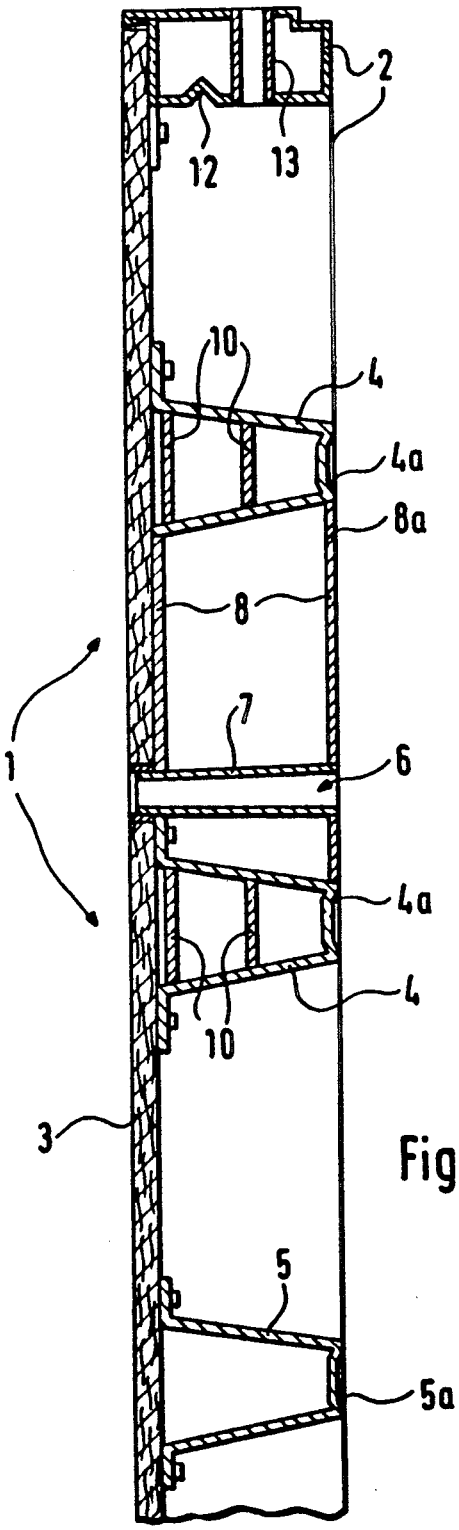
FIG. 2 is a fragmentary sectional view of the formwork panel of FIG. 1 as seen in the direction of the arrows II—II in FIG. 1.

It is evident in FIG. 1 that the anchoring locations are spaced from the edge profiles 2 and disposed at or next to a stiffening girder 4. FIG. 2 illustrates that, while the stiffening girders 4 and 5 have the same outer cross-sectional shape, the stiffening girders are reinforced and/or have a larger cross section in the region of each anchoring location 6. Weight is thereby reduced while allowing accessory parts to be fastened to all of the stiffening girders 4 and 5 using identical coupling elements.

In the illustrated embodiment, transverse connecting pieces 8 are welded between pairs of spaced, parallel stiffening girders 4. The transverse connecting pieces 8 are provided with the anchoring locations 6, and at least one of the two stiffening girders 4 joined to each transverse connecting piece 8 is reinforced as compared to the stiffening girders 5. Consequently, tension is transferred to the reinforced stiffening girders 4 by way of the transverse connecting pieces 8. In the illustrated embodiment, the transverse connecting pieces 8 are hollow profiles, preferably completely closed hollow profiles, and the sleeves 7 forming the anchoring locations 6 traverse these hollow profiles. The outer surfaces 8*a* of the transverse connecting pieces 8 are flush with the outer webs 4*a* of the stiffening girders 4. Therefore, the tension exerted on the transverse connecting pieces 8 by a clamping nut, for example, is conducted into the stiffening girders 4 over the entire depth of the same.

The stiffening girders 4 and 5 running between the edge profiles 2 are disposed parallel to one another and to one of the edges of the formwork panel 1 and, as a rule, run horizontally in the position of use, as shown in FIG. 1. The transverse connecting pieces 8 with the anchoring locations 6 are disposed between two parallel stiffening girders 4 at approximately right angles thereto. It is also possible for a formwork panel 1 to be used in a horizontal position, i.e., in a position rotated by 90 degrees from the position cf FIG. 1, because the anchoring locations 6 are spaced from all edges of the formwork panel 1.

The stiffening girders 4 and 5 may have an approximately U-shaped cross section or—as shown in FIG. 2—a trapezoidal cross section. Each of the stiffening girders 4 and 5 has an opening at one side which is closed by the forming surface 3. The profiles forming the stiffening girders 4 and 5 have holes 9 on their outer webs 4*a* and 5*a* which face away from the forming surface 3, these holes serving for the attachment of accessory parts such as supports, booms, brackets or the like.

As already mentioned, the U-shaped or trapezoidal stiffening girders 4 may be reinforced by making them of thicker sheet metal than the stiffening girders 5 in the region of the anchoring locations 6. FIG. 2 shows, however, that additionally or alternatively, stiffening webs 10, or stiffening plates or the like, may be fitted, particularly welded, into the girders 4 for the purpose of reinforcing the same proximate to the anchoring locations 6. This enables stiffening girders 4 produced from plate of the same thickness as the stiffening girders 5 to be reinforced.

Further reinforcement of the stiffening girders 4 may be achieved by providing the transverse web 4*a* which faces away from the forming surface 3 with a corrugation or similar deformation. In the illustrated embodiment, the corrugations have an approximately channel-like cross-sectional shape and are concave as viewed from the outside. In order that all of the stiffening girders 4 and 5 may have the same outer cross-sectional shape as desired, the stiffening girders 5 are also provided with a corrugation on the transverse web 5*a*.

FIG. 1 shows a formwork panel 1 of particularly large dimensions, for which the invention, and particularly the arrangement of anchoring locations at a spacing from the edges, is of special advantage. Although the formwork panel 1 is of virtually double width, it is sufficient to have only two anchoring locations 6 at each of the two levels provided with anchoring locations. The distance between these anchoring locations, as well as the distance between the anchoring locations of neighboring formwork panels, is nevertheless not too great as might be the case if the anchoring locations were provided on the edge profiles 2. In this enlarged formwork panel 1, girders 11 run approximately in the middle, parallel to the vertical edge profiles 2, and the stiffening girders 4 and 5 abut the girders 11 on either side and may be butt-welded thereto. It is possible to make such an enlarged formwork panel from two formwork panels having edge profiles 2 running round them by welding the formwork panels to each other on one longitudinal side. There will then be two girders 11 in the middle as in the illustrated embodiment.

As seen in FIG. 2, the edge profiles 2 are designed to be engaged by clamps or similar connecting members and have a channel-like depression 12 for engagement by a clamp. In addition, the edge profiles 2 have transverse holes which are reinforced by sleeves 13 and serve for the attachment of bolts, or slings for cranes or conveyors. These can be supported by the edge webs 2, because the edge webs 2 are not weakened by anchoring locations passing through them.

FIG. 2 also shows that the anchoring locations 6 are off-center with reference to the transverse connecting pieces 8, that is, are displaced towards the middle of the formwork panel 1, and hence towards a stiffening girder 4 more remote from the edge profile 2. The distance of the anchoring location from the corresponding edge of the formwork panel is thereby increased somewhat further. Therefore, jointing plates or the like can be provided without difficulty, without hindering attachment of the formwork tie rod and without any limitation being imposed on the size of the jointing plate or the like by the formwork tie rod.

The invention provides a formwork panel 1 which is simple to produce and which, due to shifting of the anchoring locations 6 more towards the middle of the formwork panel, has advantages in handling, as well as in the configuration of the edge profiles 2, because the latter are not weakened by anchoring locations. Reinforcement of the stiffening girders 4 proximate to the anchoring locations 6 can thus be readily tolerated.

I claim:

1. A formwork panel, comprising a face member having a front forming face, an opposite back surface, and peripheral marginal portions; a plurality of spaced, elongated reinforcing members longitudinally disposed against said opposite back surface; and an additional transverse member extending between two selected, adjacent ones of said reinforcing members and being spaced from said peripheral marginal portions, openings being formed in said front forming face, said opposite back surface and said additional member and being arranged to receive a tie element designed to connect said formwork panel to a second formwork panel so as to define a pouring space for flowable material.

2. The panel of claim 1, further comprising a frame for said face member at said marginal portions.

3. The panel of claim 2, wherein said frame comprises at least one profiled element which supports said face member.

4. The panel of claim 1, wherein all of said reinforcing members have substantially identical exterior shapes.

5. The panel of claim 4, wherein at least one of said selected reinforcing members is strengthened relative to others of said reinforcing members.

6. The panel of claim 4, wherein at least one of said selected reinforcing members is made of thicker material than others of said reinforcing members.

7. The panel of claim 1, wherein said additional member has a hollow interior; and further comprising a tubular element which extends through said additional member in register with said openings and is designed to receive the tie element.

8. The panel of claim 7, wherein said hollow interior is essentially entirely enclosed.

9. The panel of claim 1, wherein said additional member is flush against said selected reinforcing members.

10. The panel of claim 9, wherein said additional member is welded to said selected reinforcing members.

11. The panel of claim 1, wherein said reinforcing members and said additional member have respective rear surfaces which face away from said face member, said rear surfaces being located in a common plane.

12. The panel of claim 1, wherein said reinforcing members are substantially parallel to at least one of said marginal portions and said additional member is substantially perpendicular to said reinforcing members.

13. The panel of claim 1, wherein at least one of said reinforcing members is approximately U-shaped or trapezoidal and has an open side which confronts and is closed by said face member.

14. The panel of claim 13, wherein said one reinforcing member has another side which faces away from said face member, said other side being provided with an aperture.

15. The panel of claim 1, wherein said selected reinforcing members are approximately U-shaped or trapezoidal and are made of thicker material than others of said reinforcing members at least in the vicinity of said additional member.

16. The panel of claim 1, further comprising an elongated supporting member which extends transversely of said reinforcing members, said reinforcing members including first members which are located to one side of said supporting member and second members which are located to the opposite side of said supporting member, and said first and second members abutting said supporting member.

17. The panel of claim 16, wherein said supporting member is disposed substantially centrally of said face member.

18. The panel of claim 16, wherein said supporting member is substantially parallel to at least one of said marginal portions.

19. The panel of claim 16, wherein said first and second members are flush against said supporting member.

20. The panel of claim 16, wherein said first and second members are welded to said supporting member.

21. The panel of claim 1, further comprising profiled elements at said marginal portions defining a frame for said face member and having means for engagement by gripping elements.

22. The panel of claim 21, wherein said profiled elements are provided with transverse openings for engagement by transporting elements.

23. The panel of claim 1, wherein said selected reinforcing members are hollow and include internal stiffening elements.

24. The panel of claim 23, wherein said stiffening elements are welded to said selected reinforcing members.

25. The panel of claim 1, wherein at least one of said reinforcing members is U-shaped or trapezoidal and has a side facing away from said face member, said side being provided with a corrugation which extends longitudinally of said one reinforcing member.

26. The panel of claim 25, wherein said corrugation is channel-shaped.

27. The panel of claim 25, wherein said corrugation is concave to the exterior of said one reinforcing member.

28. The panel of claim 1, wherein said openings are offset from the center of said additional member.

29. The panel of claim 28, wherein said openings are disposed on that side of said center nearer the middle of said face member.

* * * * *